US008456462B2

(12) United States Patent
Kohno et al.

(10) Patent No.: US 8,456,462 B2
(45) Date of Patent: Jun. 4, 2013

(54) DISPLAY DEVICE

(75) Inventors: Makoto Kohno, Tokyo (JP); Nobuyuki Mori, Tokyo (JP); Seiichi Mizukoshi, Tokyo (JP)

(73) Assignee: Global OLED Technology LLC, Herndon, VA (US)

( * ) Notice: Subject to any disclaimer, the term of this patent is extended or adjusted under 35 U.S.C. 154(b) by 49 days.

(21) Appl. No.: 13/020,523

(22) Filed: Feb. 3, 2011

(65) Prior Publication Data

US 2012/0120041 A1 May 17, 2012

(30) Foreign Application Priority Data

Feb. 4, 2010 (JP) ..... 2010-023287

(51) Int. Cl.
*G09G 5/00* (2006.01)

(52) U.S. Cl.
USPC ..... 345/211

(58) Field of Classification Search
USPC ..... 345/76, 82, 204, 211; 315/169.3; 313/500
See application file for complete search history.

(56) References Cited

U.S. PATENT DOCUMENTS

| | | | | |
|---|---|---|---|---|
| 5,990,629 | A | 11/1999 | Yamada et al. | |
| 6,020,865 | A | 2/2000 | Okuda et al. | |
| 7,864,167 | B2 * | 1/2011 | Morosawa et al. | 345/204 |
| 2004/0008166 | A1 | 1/2004 | Kimura | |
| 2004/0239696 | A1 | 12/2004 | Okabe et al. | |

FOREIGN PATENT DOCUMENTS

| | | | |
|---|---|---|---|
| EP | 1184833 | A2 | 3/2002 |
| JP | 10-214060 | | 8/1998 |
| JP | 2002-351357 | | 12/2002 |
| JP | 2006-243060 | | 9/2006 |
| WO | 2004097781 | A1 | 11/2004 |

* cited by examiner

*Primary Examiner* — Abbas Abdulselam
(74) *Attorney, Agent, or Firm* — Global OLED Technology LLC

(57) ABSTRACT

Display unevenness is suppressed. A display device includes pixels (22) arranged in matrix, each including a current-driven type light emitting element (EL) and a drive transistor (Tr3) for supplying a current to the current-driven type light emitting element (EL). The current-driven type light emitting element (EL) is driven by dividing each frame period into a plurality of sub-frame periods for lighting time. The drive transistor is controlled under current write driving using two write currents having a ratio of $1:1/2^N$ and a sum of the two write currents.

4 Claims, 15 Drawing Sheets

EMBODIMENT (OVERALL VIEW)

PRIOR ART PIXEL CIRCUIT

TIME-DIVISION GRADATION DRIVING (PRIOR ART)

EMBODIMENT (OVERALL VIEW)

EMBODIMENT
(PIXEL PORTION AND SOURCE DRIVER)

WRITE OPERATION

EMISSION OPERATION

WAVEFORM

ONE-PIXEL LIGHTING EXAMPLE 1 (EMBODIMENT)

DRIVE EXAMPLE 1 (EMBODIMENT)

TIMING CONCEPT IN DRIVE EXAMPLE 1 (EMBODIMENT)

TIMING CONCEPT IN DRIVE EXAMPLE 2 (EMBODIMENT)

CURRENT SWITCH SIGNAL (EMBODIMENT)

ONE-PIXEL LIGHTING EXAMPLE 2 (EMBODIMENT)

LEVEL EXAMPLE 1 IN ONE-PIXEL LIGHTING EXAMPLE 2 (EMBODIMENT)

LEVEL EXAMPLE 2 IN ONE-PIXEL LIGHTING EXAMPLE 2 (EMBODIMENT)

DISPLAY DEVICE

The present invention claims the benefit of Japanese Patent Application No. 2010-23287, filed in Japan on Feb. 4, 2010, which is hereby incorporated by reference.

BACKGROUND OF THE INVENTION

1. Field of the Invention

The present invention relates to a display device in which pixel data for display is written into each pixel arranged in matrix, and to a drive method for the display device.

2. Description of the Related Art

There have been proposed various types of display devices, typified by the one disclosed in Japanese Patent Application Laid-open No. 1998-214060, in which gradation display is performed by dividing each frame period into a plurality of sub-frame periods for driving.

FIG. 1 illustrates a configuration of a circuit of one pixel (pixel circuit) in an organic electroluminescence (EL) display device of time-division gradation display mode disclosed in Japanese Patent Application Laid-open No. 1998-214060. In a simple 2T-1C configuration (including two transistors and one capacitor), when a gate line is at high level, a transistor Tr11 is turned ON to write a data voltage on a data line into a storage capacitor Ch. When the gate line becomes low level and the transistor Tr11 is turned OFF, a transistor Tr12 is driven with the voltage stored in the storage capacitor Ch so that a drive current corresponding to the data voltage flows through an organic EL element EL.

In a normal driving mode, the data line voltage is controlled to control a current of the transistor Tr12, thereby controlling the emission amount (luminance) of the organic EL element EL. Further, in the normal driving mode, the transistor Tr12 is used in the saturation region, and the current flowing through the transistor Tr12 is a current $I_d$, which is determined by a threshold voltage $V_{th}$, mobility μ, a gate width W, and a gate length L of the transistor Tr12, as expressed in the following expression.

$$I_d=\mu C_o(W/L)(V_{gs}-V_{th})^2$$

where $V_{gs}$ is a gate-source potential difference and $C_o$ is a gate capacitance per unit area. In a thin film transistor (TFT) formed on a glass substrate, especially a low-temperature polysilicon (LIPS) TFT, the values of the threshold voltage $V_{th}$ and the mobility μ are varied among pixels, resulting in a problem of uneven display.

As a method for solving the problem, the data voltage on the data line is written so that the transistor Tr12 may be completely turned ON to serve as a simple switch (linear region operation) for directly applying "(positive power supply voltage PVDD)-(negative power supply voltage CV)" to the organic EL element, thereby performing gradation display under lighting control with each frame divided into a plurality of sub-frames. FIG. 2 illustrates an example of the lighting method for 4-bit gradation display. As in the example, lighting time is set to $T_1$, $T_2$ (=$2T_1$), $T_4$ (=$4T_1$), or T8 (=$8T_1$) corresponding to each bit.

The voltage-driven type device illustrated in FIG. 1 as the related art has a problem of screen burn-in because luminance becomes lowered as the current amount is reduced by the influence of voltage rise due to the temporal change in the organic EL element. There is another problem that the luminance depends on pixel positions and becomes uneven because of the currents flowing through the organic EL elements in a plurality of pixels as well as voltage drop in power lines. Further, if the number of display gradations is increased, a sub-frame period becomes too short to ensure sufficient write time, which is also a problem.

In view of the above-mentioned problems, as in Japanese Patent Application Laid-open No. 2002-351357, a time-division gradation display device using a current-driven type pixel drive circuit has been proposed. However, such a display device has problems that luminance becomes uneven because of fluctuations in individual current writing and that sufficient write time cannot be ensured.

As exemplified in Japanese Patent Application Laid-open No. 2006-243060, some ideas concerning the problem of the write time inherent in the current-driven type have been proposed. However, there still remains a problem in cost because a multi-bit current source driver has a complicated configuration and it is difficult to set individual current values with accuracy. Further, because the current luminous efficiency of the organic EL element is improving year by year, it is not unusual that a maximum drive current in one pixel of the display device is 1 mA or less. In such a case, a problem of the accuracy in minimum gradation arises.

SUMMARY OF THE INVENTION

The present invention provides a display device including pixels arranged in matrix, each including a current-driven type light emitting element and a drive transistor for supplying a current to the current-driven type light emitting element, in which: the current-driven type light emitting element is driven by dividing each frame period into a plurality of sub-frame periods for lighting time; and the drive transistor is controlled under current write driving using two write currents having a ratio of $1:1/2^N$ and a sum of the two write currents.

Further, it is preferred that the display device according to the present invention further include two current sources for generating the two write currents, and that each write current be generated by a combination of the two write currents from the two current sources.

Further, it is preferred that, in the display device according to the present invention, when defining that a lighting period in a shortest sub-frame of the plurality of sub-frame periods is 1, a total of the lighting periods of the plurality of sub-frame periods be $2^N-1$ so as to perform N-bit gradation display, and to perform 2N-bit gradation display when combined with a drive current value of the write current.

Further, it is preferred that, in the display device according to the present invention, when defining that a shortest sub-frame period among the plurality of sub-frame periods is 1, each frame be constituted by one sub-frame having a length of $2^k$, where k is 0 to N−3, and three sub-frames each having a length of $2^{N-2}$, thereby providing redundancy to reduce false contouring of a moving image.

It is possible to suppress the influence of voltage rise due to fluctuations in the drive TFTs and the temporal change in the current-driven type light emitting element, and to perform uniform display operation.

DETAILED DESCRIPTION OF THE PREFERRED EMBODIMENT

Now, an embodiment of the present invention is described below with reference to the accompanying drawings.

[Outline]

In this embodiment, pixel portions are subjected to current write type control, in which a write current having a maximum current value and a write current having another current value are set. The another current value is suppressed to a relatively small ratio of $1/2^N$, such as 1/8 or 1/16, of the maximum current value so that lighting time control is performed within a range for high-speed writing by using the two write current values of the maximum current and $1/2^N$ thereof.

In this way, the order in a section for time gradation control is reduced by N bits, thereby solving the problem of the write time, which is inherent in a display device using a current-driven type circuit of time gradation display mode, to realize high-order gradation display. In addition, providing only two current set values offers an advantage in cost because of simple management and simple circuitry. It is also possible to improve luminance uniformity in the display device as a whole by integrating a circuit for correcting the two current values into a current writing section so that fluctuations in current among source lines may be corrected.

Embodiment

Figure 1:
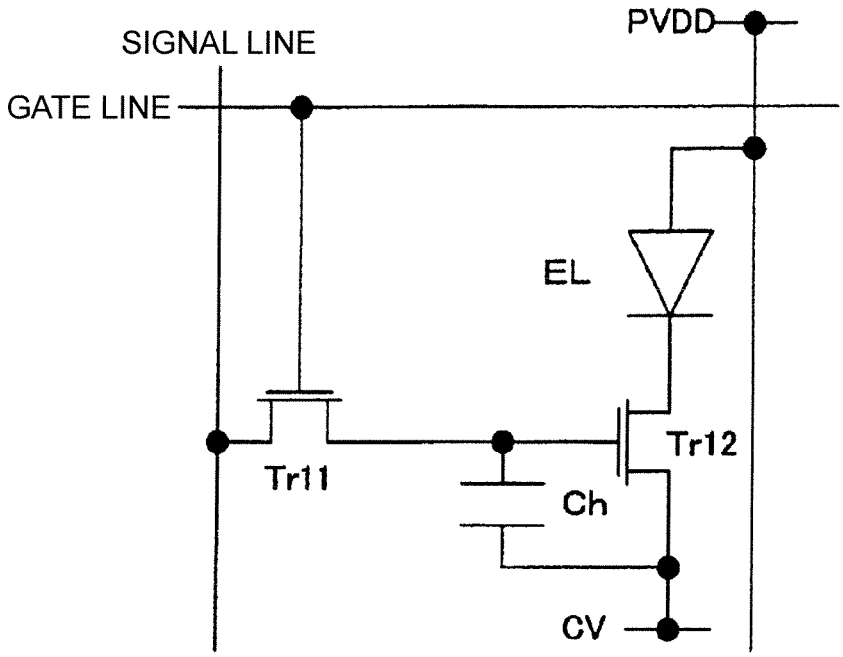
FIG. 1 is a diagram illustrating a configuration of a conventional pixel circuit.
Figure 2:
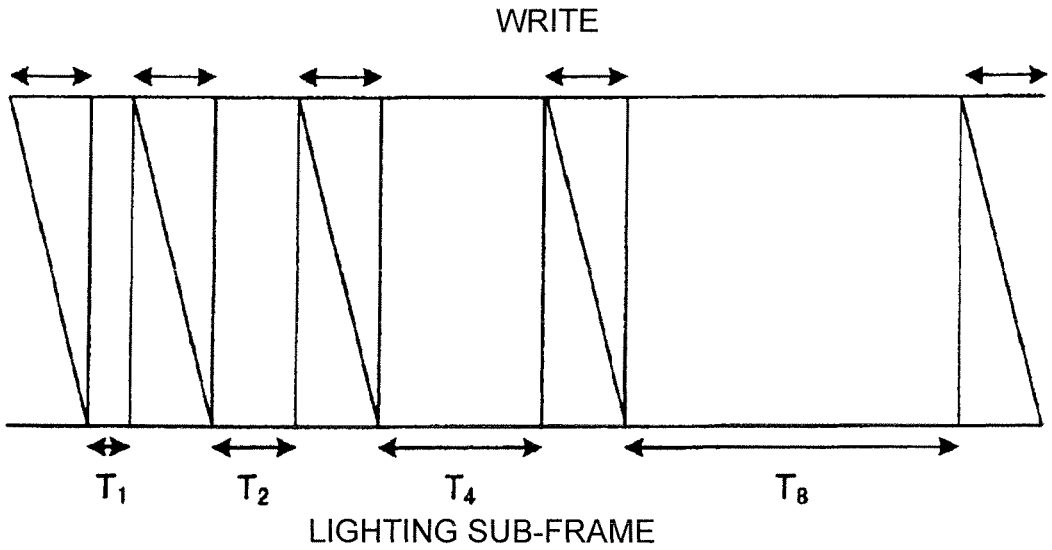
FIG. 2 is a diagram illustrating an operation of conventional time-division gradation driving.
Figure 3:
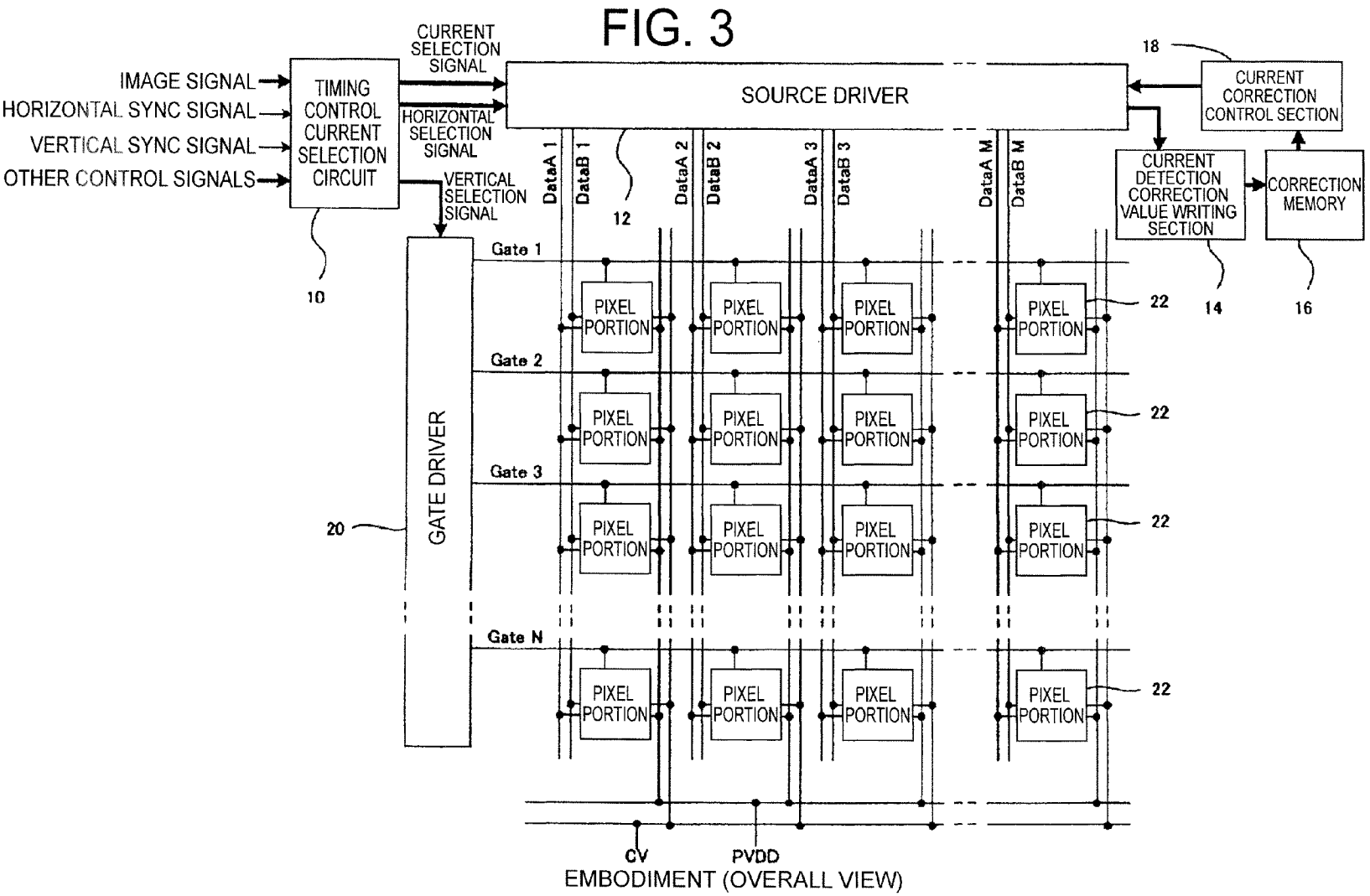
FIG. 3 is a diagram illustrating an overall configuration of a display device.
Figure 4:
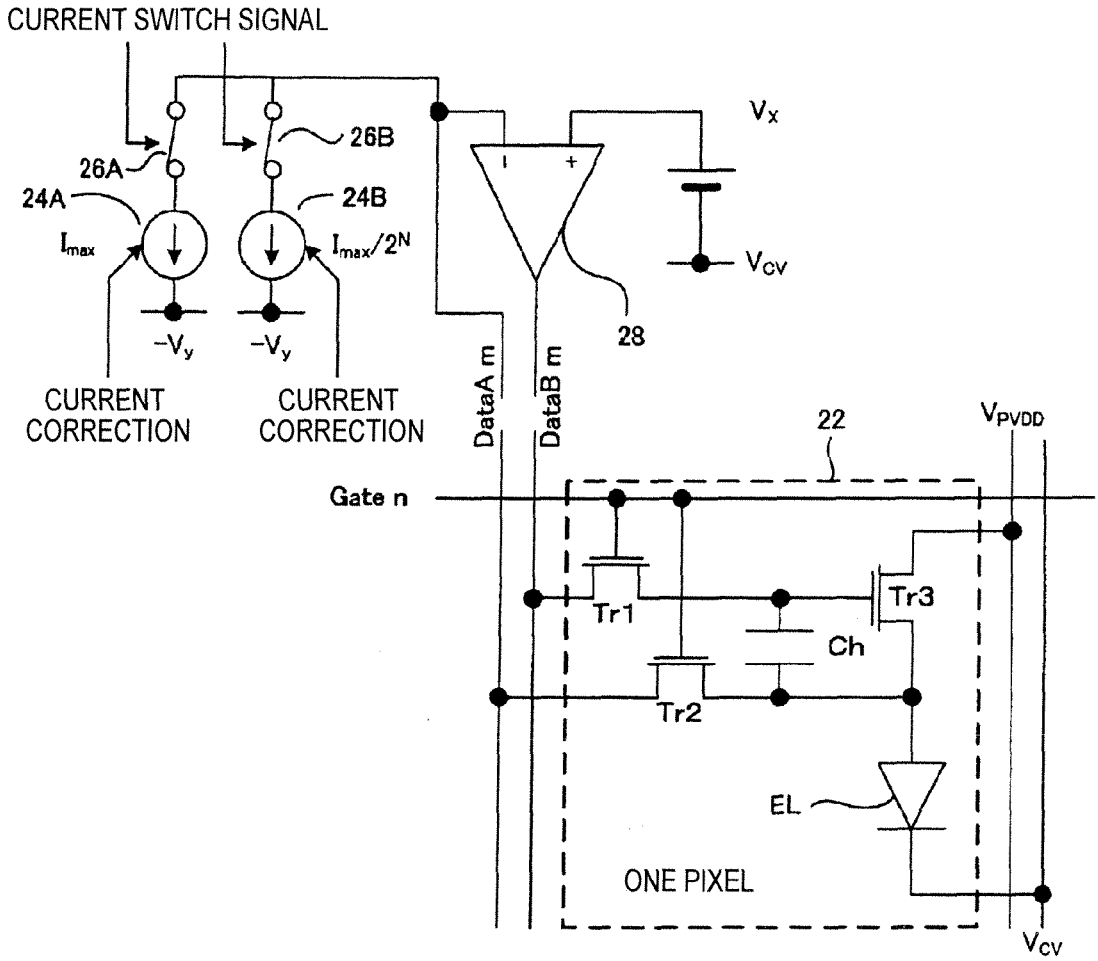
FIG. 4 is a diagram illustrating configurations of a pixel circuit and a source driver.

FIG. 3 illustrates an overall configuration of a display device as an embodiment. FIG. 4 illustrates a configuration of one pixel portion and a configuration of a source driver for one line.

As illustrated in FIG. 3, an image signal, a horizontal synchronization signal, a vertical synchronization signal, and other control signals are supplied to a timing control current selection circuit 10. A current selection signal indicating image data (bit data) of each pixel and a horizontal control signal indicating its timing are generated based on the image signal, the horizontal synchronization signal, and the like, and then supplied to a source driver 12.

The source driver 12 is connected to a current detection correction value writing section 14. The current detection correction value writing section 14 detects each current value of current sources provided for each column in the source driver 12 as described later, and determines a correction value therefor. The current detection correction value writing section 14 is connected to a correction memory 16, and the determined correction value of the current sources for each column is written into the correction memory 16 by the current detection correction value writing section 14. A current correction control section 18 reads out the correction value stored in the correction memory 16 according to a column having pixels to be written, and supplies the read correction value to the source driver 12. Therefore, each constant current value of the two current sources provided for each column in the source driver 12 is corrected by the correction value stored in the correction memory 16.

A vertical control signal from the timing control current selection circuit 10 is supplied to a gate driver 20. The gate driver 20 sequentially supplies power to gate lines Gate provided for rows of pixels 22. In other words, the source driver 12 sequentially receives the current selection signals on the pixels and outputs the image signal on the pixels in each column, and the image signal is controlled to be supplied to a corresponding row selected by the gate driver 20.

Note that, each pixel 22 is supplied with power supply voltages PVDD and CV. In general, one of the power supply voltages is connected to a supply electrode of an organic electroluminescence (EL) element and another thereof is connected to a drive transistor.

FIG. 4 illustrates a pixel circuit corresponding to one pixel, and a write circuit of current write type for pixel data, which is provided for each column of the source driver 12.

The pixel 22 is constituted by three transistors and one capacitor. A transistor Tr1 has a source connected to a data line DataB and a drain connected to a gate of a transistor Tr3. A transistor Tr2 has a source connected to a data line DataA and a drain connected to a source of the transistor Tr3. A storage capacitor Ch is disposed between the gate and source of the transistor Tr3. The transistor Tr3 has a drain connected to the power source PVDD having a voltage $V_{PVDD}$. The source thereof is connected to an anode of an organic EL element EL. The organic EL element EL has a cathode connected to the power source CV having a voltage $V_{CV}$. Note that, in the organic EL element EL, the anode serves as a pixel electrode and the cathode serves as a common electrode for all the pixels.

In the source driver 12, two current sources 24A and 24B are provided. The current source 24A has a constant current $I_{max}$ and the current source 24B has a constant current $I_{max}/2^N$. The current source 24A and the current source 24B are connected in common via a switch 26A and a switch 26B, respectively. A common connection terminal of the switches 26A and 26B is connected to a negative input terminal of an operational amplifier 28. A positive input terminal of the operational amplifier 28 is connected to a power source $V_X$ and supplied with a voltage $V_x$. An output terminal thereof is connected to the data line DataB. The common connection terminal of the switches 26A and 26B, which is connected to the negative input terminal of the operational amplifier 28, is further connected to the data line DataA. The example of FIG. 4 illustrates the data lines DataA and DataB in the m-th column.

In the configuration described above, the circuits used as the pixel circuit and the source driver have a simple 3T-1C configuration and form a feedback loop in two source lines by the operational circuit and the current sources illustrated in the upper part of FIG. 4, so as to shorten the write time.

Figure 5:
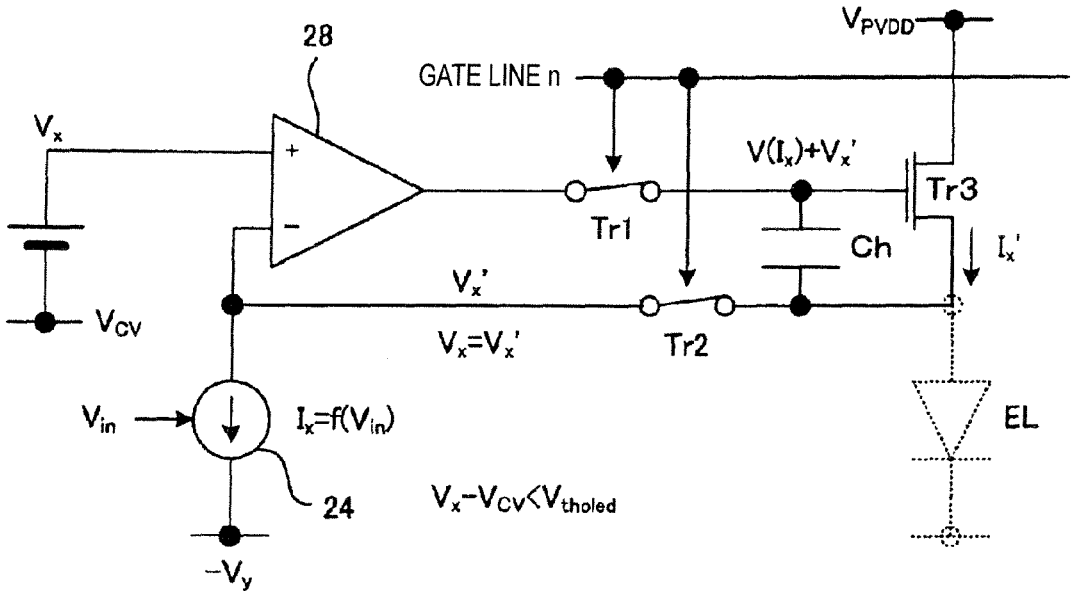
FIG. 5 is a diagram illustrating a write operation.
Figure 6:
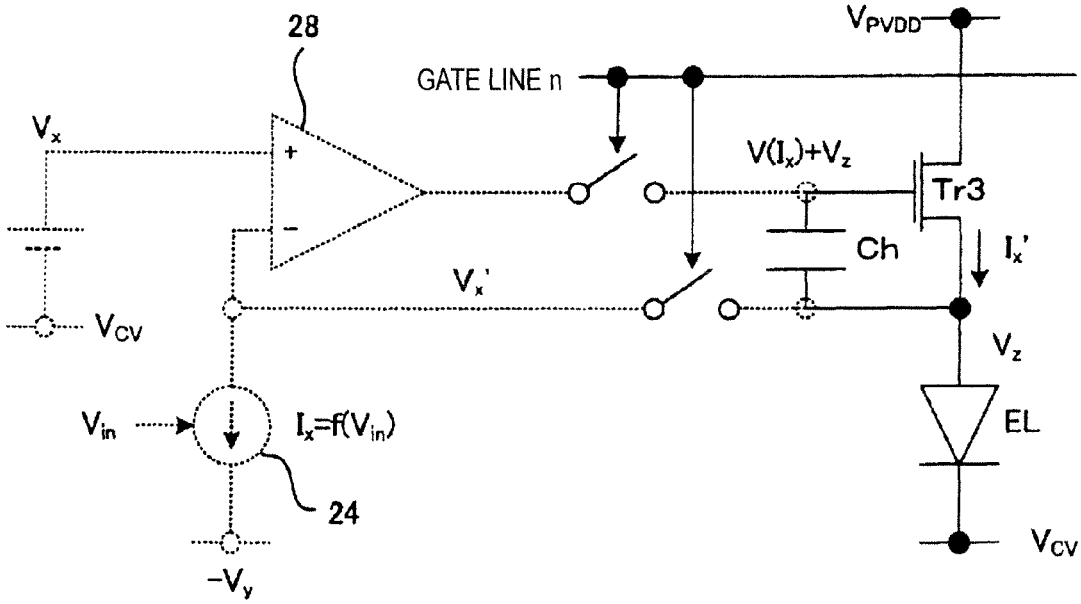
FIG. 6 is a diagram illustrating an emission operation.

FIGS. 5 and 6 illustrate the principles of writing and light emission in the configuration described above, respectively. In FIGS. 5 and 6, a current source 24 represents a current source which is formed of the current sources 24A and 24B and the switches 26A and 26B and is thus capable of adjusting the current amount, and the current source 24 supplies a current $I_x=f(V_{in})$. In other words, the current amount to be output is set by controlling ON/OFF of the switches 26A and 26B according to a data signal $V_{in}$.

In the configuration described above, when a horizontally-extending gate line n (Gate) is changed to high level to turn ON selection TFTs (transistor Tr1 and transistor Tr2), the circuit including the operational amplifier operates as a voltage follower. Then, a gate voltage of the transistor Tr3 is controlled so that a source potential $V_x'$ of the transistor Tr3 may be equal to the voltage $V_x$ at the positive input terminal of the operational amplifier 28.

On this occasion, the reference voltage $V_x$ of the voltage follower is set to a voltage for turning OFF the organic EL element EL as a light emitting element, and hence the current $I_x$ drawn into the current source 24 becomes equal to a current $I_x'$ flowing through the transistor Tr3. Then, the gate potential of the transistor Tr3 at that time is charged into the storage capacitor Ch.

In other words, if both of the transistors Tr1 and Tr2 are turned ON, as illustrated in FIG. 5, no current flows through the organic EL element EL but the current $I_x=I_x'$ flows through the transistor Tr3, with the result that the source voltage $V_x'$ thereof becomes equal to a negative input terminal voltage (=positive input terminal voltage $V_x$) of the operational amplifier. A gate-source voltage of the transistor Tr3 on this occasion is a voltage $V(I_x)$ at which the current $I_x$ flows through the transistor Tr3. Therefore, the gate voltage of the transistor Tr3 takes a value determined by adding the gate-source voltage $V(I_x)$ to the source voltage $V_x$.

Subsequently, the gate line n is changed to low level to turn OFF the transistors Tr1 and Tr2, and the voltage charged in the storage capacitor Ch maintains the gate-source voltage of the transistor Tr3, allowing the organic EL element to emit light by bootstrapping. In other words, the transistor Tr3 maintains the current $I_x$, and an anode voltage of the organic EL element EL is increased to a voltage $V_z$ which is obtained when the current $I_x$ flows through the organic EL element, with the result that the organic EL element emits light.

Figure 7:
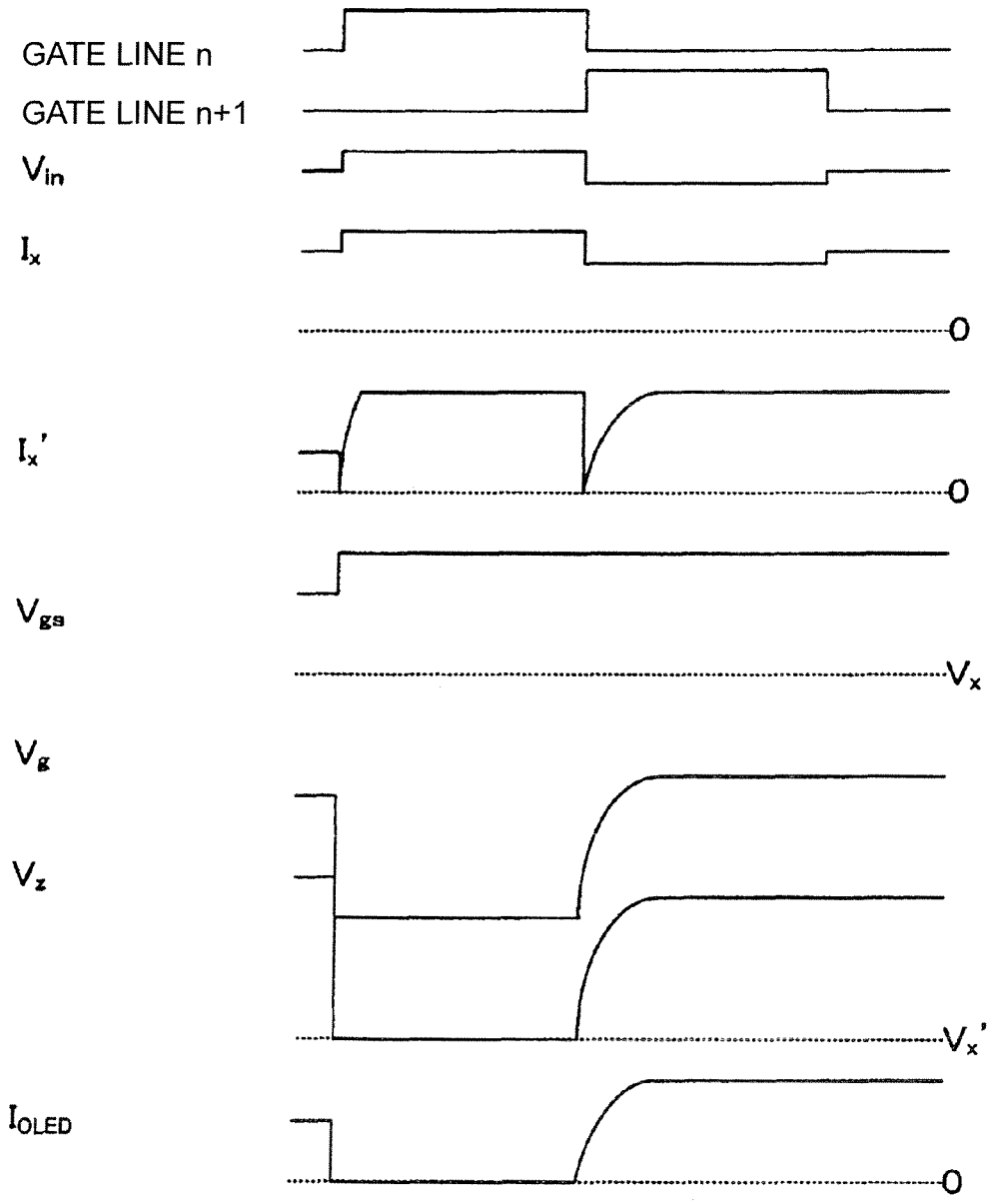
FIG. 7 is a diagram illustrating waveforms in respective sections.

FIG. 7 illustrates voltage waveforms at that time. The gate lines Gate are sequentially turned ON. The data signal $V_{in}$ sequentially supplies the constant current source 24 with data on pixels in each row. Accordingly, the constant current source 24 sequentially supplies the current $I_x$ corresponding to the data signal $V_{in}$.

In FIG. 7, $I_x'$ to $I_{OLED}$ represent each state of pixels in the n-th row. When the gate line n is at the high level, the current $I_x'$ of the transistor Tr3 becomes equal to the current $I_x$. On this occasion, a gate-source voltage $V_{gs}$ of the transistor Tr3 is set to the voltage $V(I_x)$ corresponding to the current $I_x$, and the voltage $V(I_x)$ is stored in the storage capacitor Ch. In a write period, the anode voltage $V_z$ of the organic EL element EL becomes equal to the voltage $V_x'$ (=$V_x$), and a gate voltage $V_g$ of the transistor Tr3 becomes higher than the anode voltage of the organic EL element EL by $V(I_x)$.

When the transistors Tr1 and Tr2 are turned OFF, the data line DataA and the data line DataB are disconnected from the pixel circuit but the gate-source voltage $V_{gs}$ of the transistor Tr3 is maintained, and hence the current $I_x'$ of the transistor Tr3 and the current I of the organic EL element EL are both made equal to the current $I_x$.

Next, description is given of gradation control with the current amounts of the current sources 24A and 24B set to $I_{max}$ and $I_{max}/8$, which is 1/8 of $I_{max}$, respectively.

Figure 8:
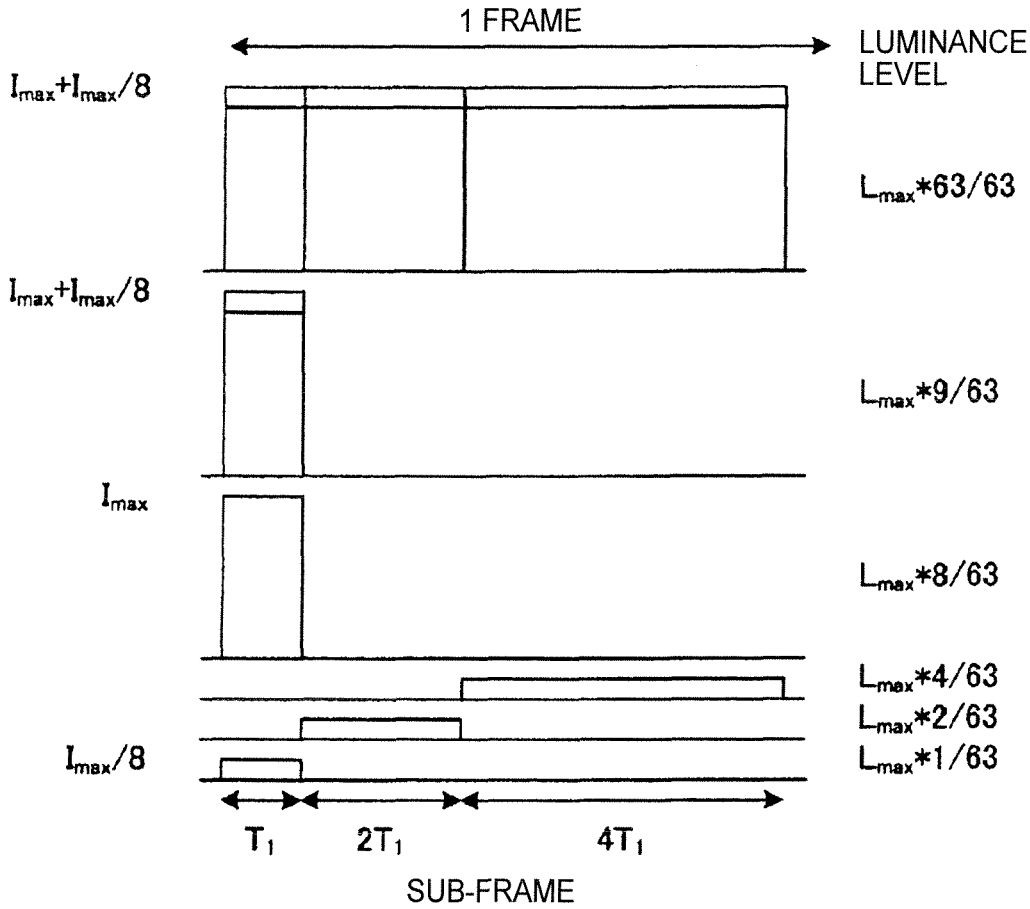
FIG. 8 is a diagram illustrating gradation expression in one-pixel lighting.

In Drive Example 1, those two kinds of drive currents and three kinds of sub-frames ($T_1$, $2T_1$, and $4T_1$) are used to perform gradation display of 6 bits in total. FIG. 8 illustrates an example of lighting one pixel, FIG. 9 illustrates drive waveforms of the gate lines in this case, and FIG. 10 is a conceptual diagram thereof.

If the minimum average luminance is obtained when the pixel is lit with $I_{max}/8$ for $T_1$, the maximum average luminance corresponds to the case of lighting with "$I_{max}/8+I_{max}$" for a whole period, and is estimated as $(1+8)\times(1+2+4)=63$ times the minimum average luminance. In other words, luminance obtained by lighting with the current "$I_{max}/8+I_{max}$" for a period $7T_1$ is a maximum average luminance $L_{max}$, and an average luminance obtained by lighting with the current $I_{max}/8$ only for the period $T_1$ takes $L_{max}/63$. The gradation expression of 6 bits from 0 to 63 can be performed by a combination of $L_{max}\times1/63$, $L_{max}\times2/63$, $L_{max}\times4/63$, and $L_{max}\times8/63$ illustrated in FIG. 8.

Figure 9:
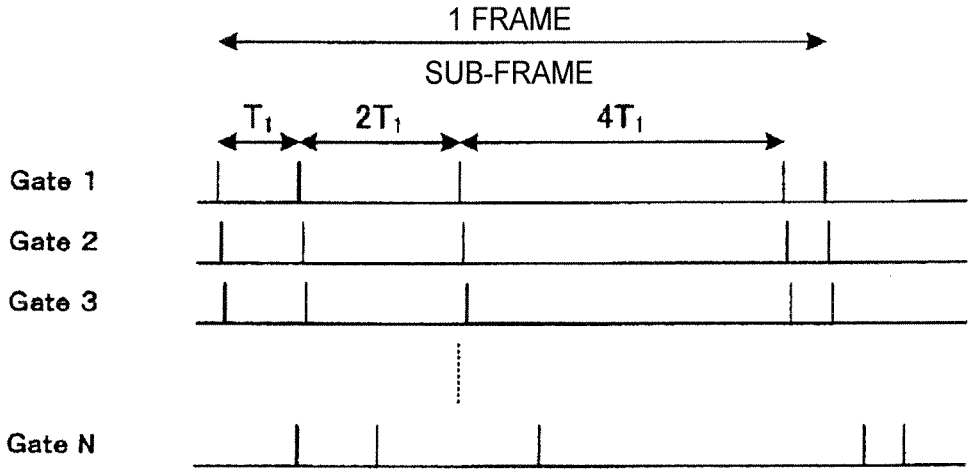
FIG. 9 is a diagram illustrating drive timings of gate lines.
Figure 10:
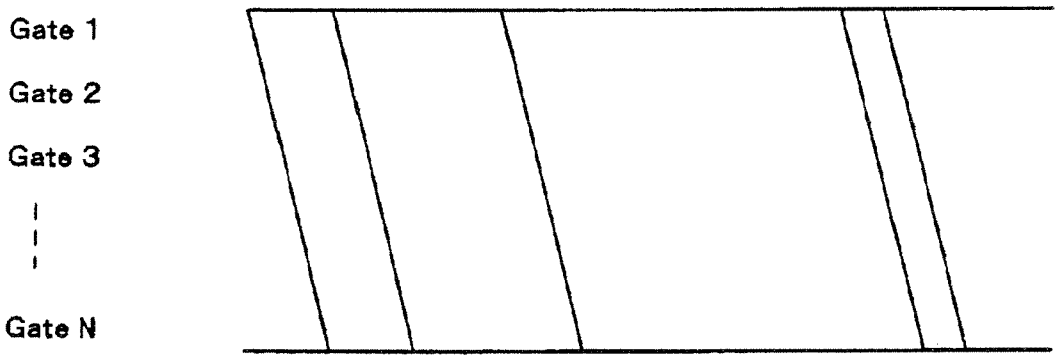
FIG. 10 is a diagram illustrating a drive timing concept.

As illustrated in FIGS. 9 and 10, the gate lines are sequentially driven with respect to the respective sub-frames to write data, to thereby perform lighting control on the respective sub-frames.

Figure 11:
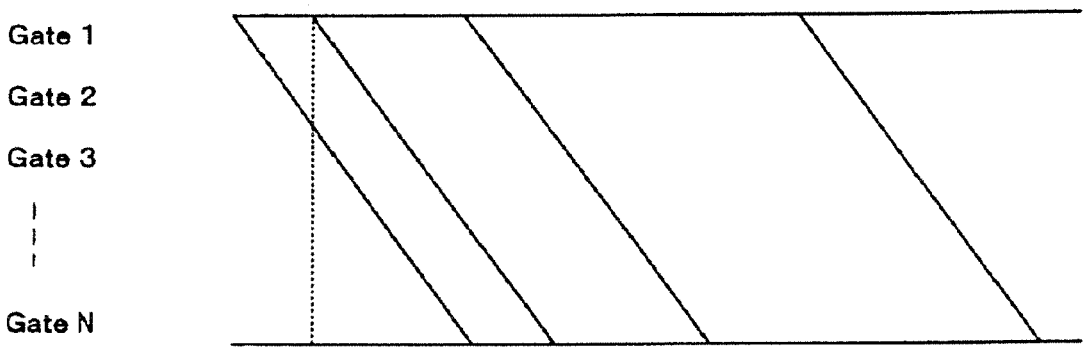
FIG. 11 is a diagram illustrating another drive timing concept.

As Drive Example 2, FIG. 11 illustrates a conceptual diagram of drive waveforms for weakening the constraints on drive time. FIG. 11 illustrates the case where two gate lines are written at the same timing during horizontal writing. The write period is divided and data is written in pixels in the two corresponding lines. Note that, it is also preferred that the constraints on the drive time be further weakened by multi-line writing, such as simultaneous writing for three lines.

Figure 12:
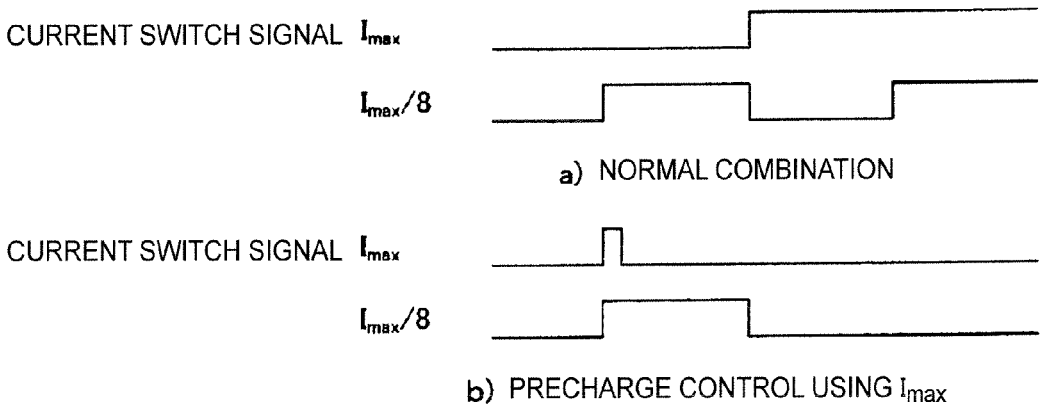
FIG. 12 is a diagram illustrating an example of current switching for precharging.

Further, as illustrated in FIG. 12, it is also preferred that the write time be reduced by performing precharge operation of activating the current $I_{max}$ for a short period of time during the writing with $I_{max}/8$. This enables reliable data writing into the storage capacitor Ch based on a small current value.

Still further, it is also preferred that the outputs of the circuits in the source driver 12 be cramped to $V_{CV}$ during turn-OFF operation, thereby performing the turn-OFF operation reliably and speedily. In other words, in a sub-frame in which light is OFF, during the write period, $V_{CV}$ may be supplied to the positive input terminal of the operational amplifier 28 while bypassing $V_X$ in FIG. 4, so as to quickly discharge the charges stored in the storage capacitor Ch.

Figure 13:
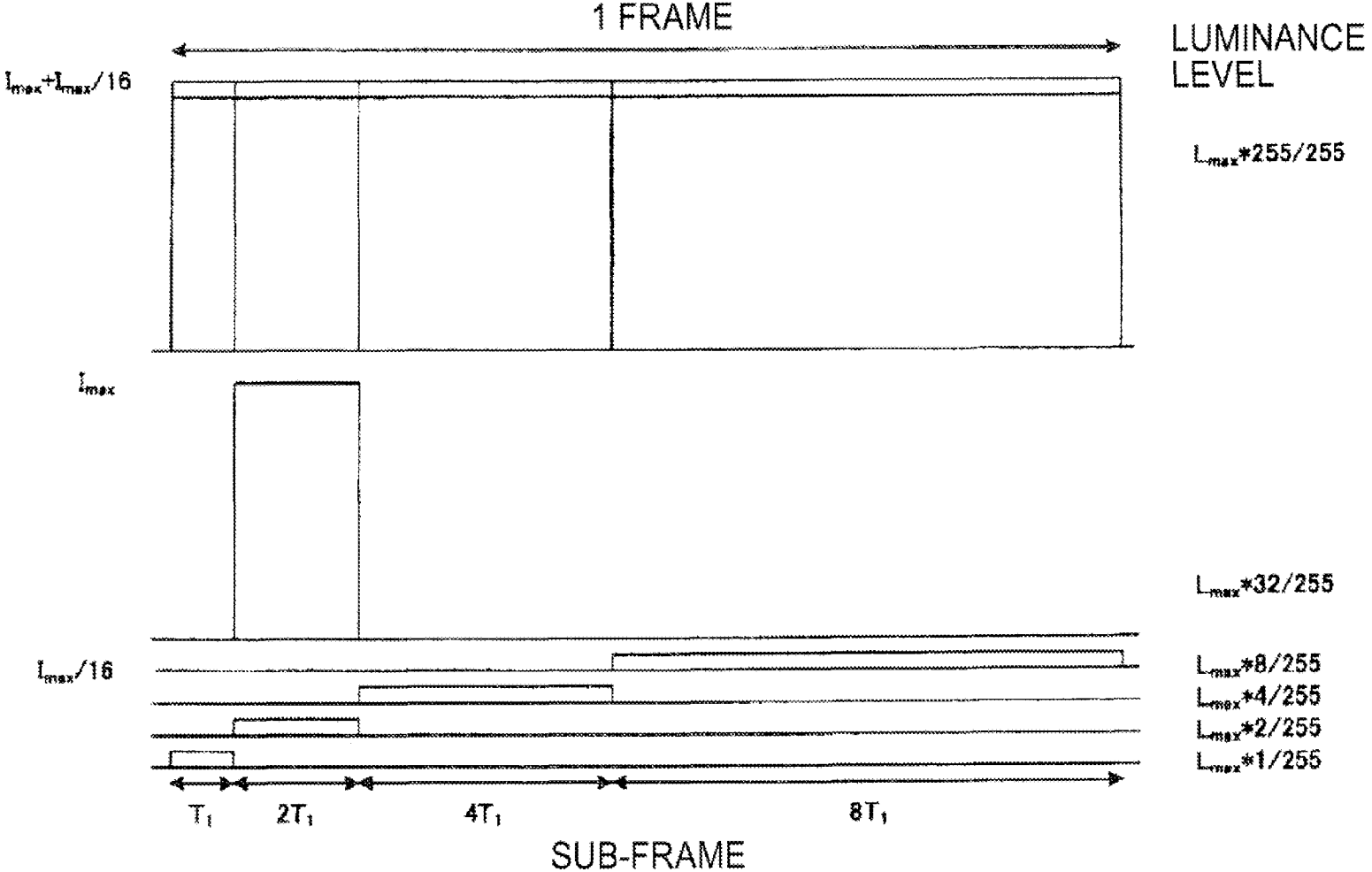
FIG. 13 is a diagram illustrating another gradation expression in one-pixel lighting.

FIG. 13 illustrates an example of lighting one pixel for gradation display of 8 bits in total using two drive currents of $I_{max}$ and $I_{max}/16$, which is 1/16 of $I_{max}$, and simple sub-frames. In this example, in order to perform the gradation display of 8 bits, the number of sub-frame bits is 4 and the drive current ratio is set to $2^4$.

Figure 14:
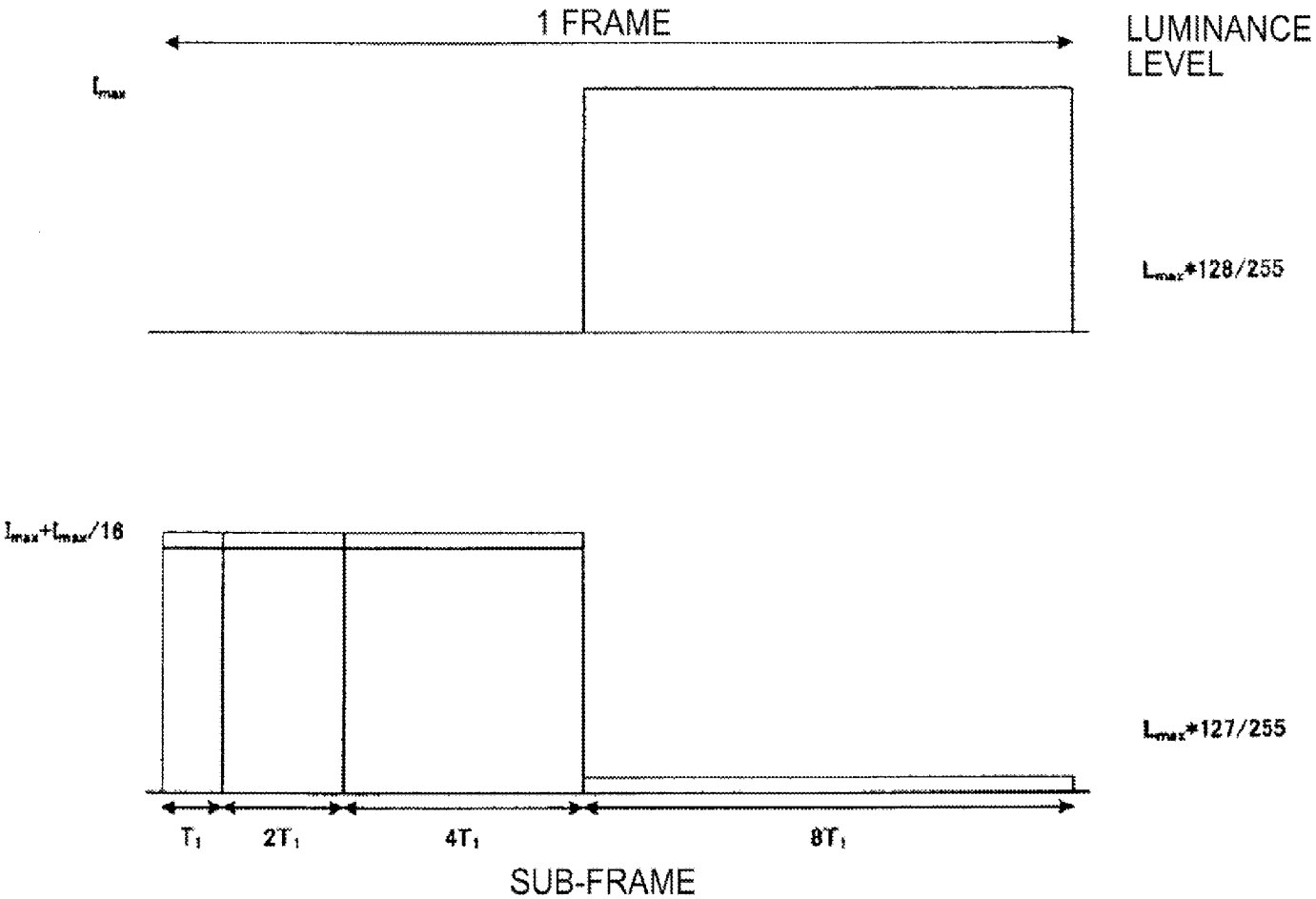
FIG. 14 is a diagram illustrating a lighting example in one-pixel lighting.

This configuration has a problem of occurrence of false contouring. Specifically, for example, a gradation change point as illustrated in FIG. 14 is present in a moving image. In this example, when the sub-frames are switched from luminance levels 127 to 128, the gradation is changed from the full-lighting for the period $7T_1$ in the first half and the lighting with the minimum luminance for the period $8T_1$ in the second half, to the turn-OFF in the first half and the full-lighting in the second half.

Figure 15:
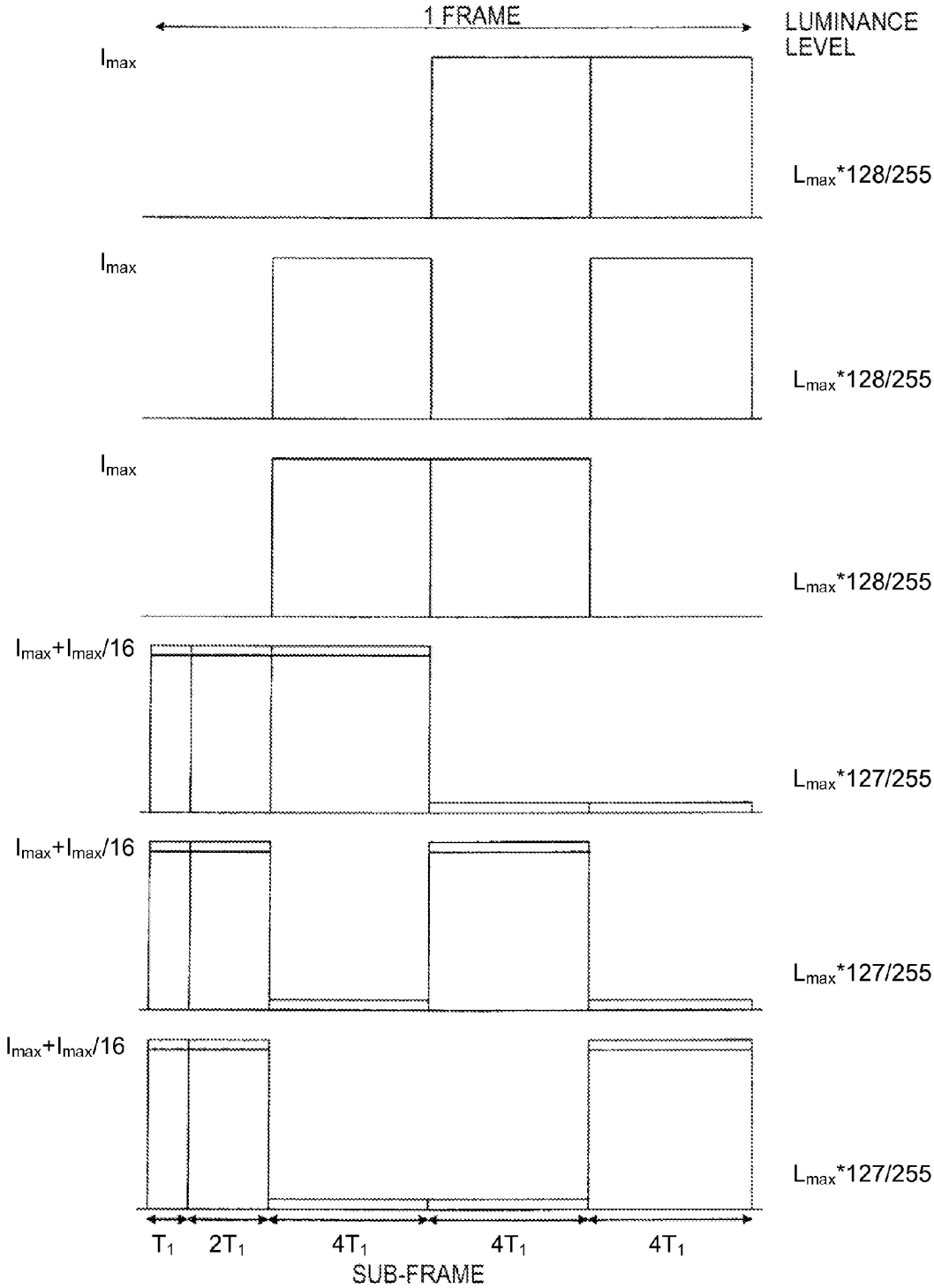
FIG. 15 is a diagram illustrating a lighting example of one-pixel lighting at redundant lighting timings.

Regarding such a large change point, the longest sub-frame is divided into two, and as illustrated in FIG. 15, display with redundant level of lighting is performed while switching the lighting as appropriate on a frame basis or a pixel basis, to thereby make the false contouring less visually recognizable. In other words, the sub-frame of $8T_1$ is eliminated but three sub-frames of $4T_1$ are provided so that three kinds of lighting modes may be formed for 128 gradations, and the lighting modes are selected as appropriate to reduce the occurrence of false contouring.

Further, if the source driver in the configuration of FIG. 6 is configured as an external IC, it is possible to test the organic EL element in the display portion before mounted, and hence the yield of display devices is improved. In this case, it is preferred in view of accuracy and cost that the current detection and correction sections be built in the external IC.

Note that, the configuration of this embodiment is also applicable to a display device using other current-driven type light emitting elements than the organic EL element.

What is claimed is:

1. A display device, comprising pixels arranged in a matrix, each including a current-driven type light emitting element and a drive transistor for supplying a current to the current driven type light emitting element, wherein the current-driven type light emitting element is driven by dividing each frame period into a plurality of sub-frame periods for lighting time, and wherein the drive transistor is controlled under current write driving using two write currents having a ratio of $1:1/2^N$, where N is the number of sub-frames, and a sum of the two write currents.

2. A display device according to claim 1, further comprising two current sources for generating the two write currents, wherein each write current is generated by a combination of the two write currents from the two current sources.

3. A display device according to claim 1 or 2, wherein, when defining that a lighting period in a shortest sub-frame of the plurality of sub-frame periods is 1, a total of the lighting periods of the plurality of sub-frames periods is $2^N-1$ so as to perform N-bit gradation display, and to perform 2N-bit gradation display when combined with a drive current value of the write current.

4. A display device according to any one of claims 1 to 3, wherein, when defining that a lighting period in a shortest sub-frame of the plurality of sub-frame periods is 1, each frame is constituted by one sub-frame having a length of $2^k$, where k is 0 to N−3, and three sub-frames each having a length of $2^N-2$, thereby providing redundancy to reduce false contouring of a moving image.

* * * * *